US006627879B2

(12) United States Patent
Reilly et al.

(10) Patent No.: US 6,627,879 B2
(45) Date of Patent: Sep. 30, 2003

(54) VOLTAGE PULSER CIRCUIT

(75) Inventors: James P. Reilly, Bloomington, IN (US); Noah P. Christian, Bloomington, IN (US)

(73) Assignee: Advanced Research and Technology Institute, Inc., Indianapolis, IN (US)

( * ) Notice: Subject to any disclaimer, the term of this patent is extended or adjusted under 35 U.S.C. 154(b) by 0 days.

(21) Appl. No.: 10/223,424

(22) Filed: Aug. 19, 2002

(65) Prior Publication Data

US 2003/0001089 A1 Jan. 2, 2003

Related U.S. Application Data

(63) Continuation of application No. 09/313,923, filed on May 18, 1999, now Pat. No. 6,437,325.

(51) Int. Cl.[7] ..... H01J 49/40

(52) U.S. Cl. ..... 250/287; 327/183; 327/304; 327/305; 315/344

(58) Field of Search ..... 250/287, 252.1; 327/183, 304, 305; 315/344

(56) References Cited

U.S. PATENT DOCUMENTS

| | | | | | |
|---|---|---|---|---|---|
| 3,792,358 | A | * | 2/1974 | Lewis et al. | 325/128 |
| 4,245,194 | A | * | 1/1981 | Fahlen et al. | 331/94.5 |
| 4,596,945 | A | * | 6/1986 | Schumacher et al. | 315/344 |
| 5,212,425 | A | * | 5/1993 | Goebel et al. | 315/111.21 |
| 6,437,325 | B1 | * | 8/2002 | Reilly et al. | 250/252.1 |

* cited by examiner

*Primary Examiner*—Kiet T. Nguyen
(74) *Attorney, Agent, or Firm*—Barnes & Thornburg

(57) ABSTRACT

One illustrative embodiment of a voltage pulser circuit comprises a voltage source producing a first voltage, and a thyratron tube having an anode coupled to the output of the voltage source, a cathode connected to a reference potential and a grid responsive to a grid control voltage to electrically connect the anode to the cathode to thereby cause the first thyratron tube to switch the anode between the first voltage and the reference potential. A pulse-shaping circuit may be connected to the anode of the tube to effectuate desired rise and fall times of the voltage pulses produced by the voltage pulser circuit. Such a voltage pulser circuit is particularly suited for use in connection with the operation of pulsed spectrometer instruments, such as time-of-flight mass spectrometers and the like.

28 Claims, 8 Drawing Sheets

VOLTAGE PULSER CIRCUIT

CROSS-REFERENCE TO RELATED APPLICATION

This is a continuation of U.S. patent application Ser. No. 09/313,923, now U.S. Pat. No. 6,437,325, filed May 18, 1999 entitled SYSTEM AND METHOD FOR CALIBRATING TIME-OF-FLIGHT MASS SPECTRA ION SEPARATION INSTRUMENT.

FIELD OF THE INVENTION

The present invention relates generally to techniques for determining mass values from time-of-flight information in time-of-flight mass spectrometry, and more specifically to techniques for calibrating time-of-flight mass spectra to thereby improve the accuracy of such mass value determinations.

BACKGROUND OF THE INVENTION

In the field of time-of-flight (TOF) mass spectrometry, instrumentation and operational techniques directed at maximizing mass resolution are known. An example of one such technique is detailed in U.S. Pat. Nos. 5,504,326, 5,510,613 and 5,712,479 to Reilly et al., each of which are assigned to the assignee of the present invention. The Reilly et al. references describe a spatial-velocity correlation focusing technique that provides for improved resolution in time-of-flight measurements. However, as with any TOF instrument, the measured time-of-flight data must be subsequently converted to corresponding mass values in order to provide useful mass information.

Accurate conversion of time-of-flight data to mass values typically requires calibration of experimentally measured time-of-flight mass spectra using known mass value information. Heretofore, various curve fitting techniques have been used for calibrating time of flight mass spectra. It is known that the mass-to-charge ratio (m/z) of an ion traveling through a TOF mass spectrometer is approximately proportional to the square of its time of flight, and this relationship is commonly used in known curve fitting techniques to numerically solve for a set of coefficients in a polynomial representation relating time-of-flight to mass. The exact equation used may vary depending upon the instrument configuration and accuracy required, and a variety of graphing, numerical and mass spectral analysis software packages are commercially available for rapidly performing such calibrations.

While curve fitting techniques have been widely accepted and used for performing mass spectra calibrations, such techniques have several drawbacks associated therewith. For example, all known curve fitting and neural network techniques are devoid of information contained in electrostatic ion calculations and are therefore independent of TOF mass spectrometer operating parameters. Ion times of flight, particularly when using delayed extraction techniques, have an infinite expansion of high order non-linearities that can adversely affect the accuracy of curve fitting techniques. Curve fitting techniques can compensate for such non-linearities by including additional terms in the series expansion of the mass/TOF equation, although a regression fit of mass calibrants to a function is generally devoid of information relating to instrument operating conditions that can describe ion behavior, and is therefore missing information that may be useful in mass calibration. A second drawback with known curve fitting techniques used for mass spectra calibration is that the accuracy of such techniques can decrease significantly outside of the mass range of the calibration.

What is therefore needed is an improved time-of-flight mass spectra calibration technique that addresses at least the foregoing drawbacks of known mass calibration techniques.

SUMMARY OF THE INVENTION

The foregoing shortcomings of the prior art are addressed by the present invention. In accordance with one aspect of the present invention, a system for calibrating time-of-flight (TOF) mass spectra comprises a memory having a plurality of TOF mass spectrometer instrument operational parameters and at least one known mass value and associated measured time of flight value stored therein, and a computer in communication with the memory. The computer is operable to compute a time of flight of said at least one known mass value as an electrostatic function of the plurality of instrument operational parameters and adjust at least one of the plurality of instrument operational parameters to thereby minimize a difference between the computed time of flight and the measured time of flight value.

In accordance with another aspect of the present invention, a method of calibrating time-of-flight (TOF) mass spectra comprises the steps of providing a plurality of TOF mass spectrometer instrument operational parameters, providing at least one known mass value and associated measured time of flight value therefore, computing a time of flight of said at least one known mass value as an electrostatic function of the plurality of instrument operational parameters, and adjusting at least one of the instrument operational parameters to thereby minimize a difference between the computed time of flight and the measured time of flight value.

In accordance with a further aspect of the present invention, a method of calibrating time-of-flight (TOF) mass spectra comprises the steps of providing a plurality of TOF mass spectrometer instrument operational parameters, providing at least one known mass value and associated measured time of flight value therefore, computing a time of flight of said at least one known mass value as an electrostatic function of the plurality of instrument operational parameters, and iteratively optimizing at least one of the plurality of instrument operating parameters until the time of flight computed as an electrostatic function of the plurality of instrument operating parameters matches the measured time of flight value within a predetermined error tolerance value.

One object of the present invention is to provide a system and method for improving the accuracy of mass value determinations based on time-of-flight information provided by a time-of-flight mass spectrometer.

Another object of the present invention is to improve the accuracy of mass value determinations by providing for an improved technique for calibrating time of flight mass spectra.

Yet another object of the present invention is to provide a time of flight mass spectra calibration technique that is based on physical operational parameters of the mass spectrometer instrument rather than on a conventional calibration equation containing a collection of terms representing approximate or arbitrary factors.

These and other objects of the present invention will become more apparent from the following description of the preferred embodiments.

DESCRIPTION OF THE PREFERRED EMBODIMENTS

Figure 1:
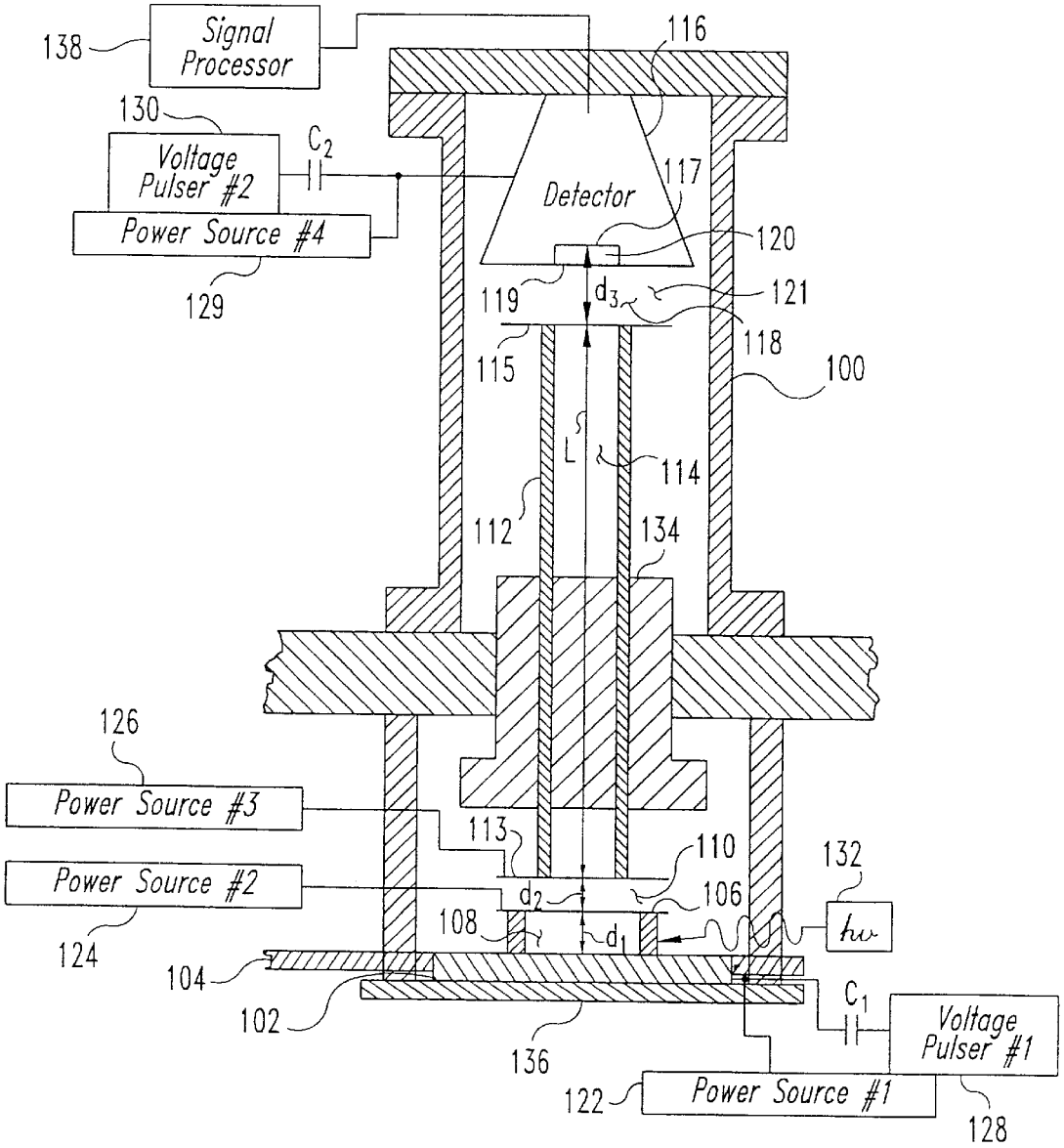
Fig. 1 (PRIOR ART)
FIG. 1 is a cross-section of a prior art time-of-flight (TOF) mass spectrometer illustrating at least some of the operational parameters of an instrument of this type.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Referring now to FIG. 1, a prior art time-of-flight (TOF) mass spectrometer 100 is shown. In the embodiment 100 shown in FIG. 1, power sources 122 and 124, and voltage pulser 128 are preferably actuated with specific timing and magnitude, depending on the internal geometry of the TOFMS 100 and the ion generation geometry, to simultaneously minimize the effects of initial position distribution and initial velocity distribution of the generated ions on the mass resolution of the TOFMS. Further details of such operation as well as details regarding some alternative ion source geometries are provided in U.S. Pat. Nos. 5,504,326, 5,510,613 and 5,712,479 to Reilly et al., each of which are assigned to the assignee of the present invention, and each of which are incorporated herein by reference.

In a preferred embodiment, power sources 122, 124, 126, and 129 are DC high voltage power supplies. Alternatively, supplies 122 and/or 124 may supply time dependent voltages that originally modify the spatial and velocity distributions of the ions before application of the output from voltage pulser 128. Careful selection of these and other TOFMS parameters significantly reduces the mass spectral peak broadening due to the initial ion velocity and spatial distributions as more fully described in the above-identified Reilly et al. references.

Voltage plate 102 and voltage grid 106 are arranged in a juxtaposed relationship and define a first region 108 therebetween. Region 106 has length $d_1$ and contains the sample source 104. Although sample source 104 is shown as being located within a groove of voltage plate 102 so that the surface of the sample source 104 is coextensive with the surface of plate 102, the present invention contemplates locating sample source 104 at a variety of locations within region 108.

In a preferred embodiment, sample source 104 is a stainless steel surface with the sample deposited thereon. Alternatively, sample source 104 may be a conductive metal grid or metal plate, a dielectric surface with or without a thin metallic film coating or a comparable structure having an orifice through which sample molecules flow.

Also in a preferred embodiment, voltage plate 102 is a flat, highly conductive, metallic plate having a groove through the center of its surface for receiving the sample source 104. Voltage grid 113 is juxtaposed with voltage grid 106 and a second region 110 of length $d_2$ is defined therebetween. A flight tube 112 is connected between voltage grid 113 and grid 115. Flight tube 112 is constructed of a conducting material, typically stainless steel or aluminum, and has a channel 114 disposed therethrough which defines an ion drift region of length L. Ion detector 116 is juxtaposed with the grid 115 of flight tube 112 and a third region of length $d_3$ is defined between grid 115 and a front surface 117 of a suitable detector 116 such as a microchannel plate detector. Supports 134 and 136 are used to stabilize flight tube 112 and voltage plate 102 respectively within the TOFMS 100, and are preferably made of Teflon™ or ceramic. In one embodiment, structures 106, 113 and 115 are constructed of high conductivity metal screen or similar structure having slits or apertures disposed therethrough so that ions may pass through such slits or apertures. In an alternative embodiment, structures 106, 113 and 115 comprise high conductivity gridless metallic plates having a central hole, or a series of holes disposed through the centers thereof, for allowing the passage of ions therethrough. Although not specifically illustrated in FIG. 1, those skilled in the art will recognize that with gridless structures, electrostatic ion lenses of known construction are typically juxtaposed over the central holes or series of holes for focusing ion packets traveling therethrough as is known in the art. In any event, regardless of the configuration of structures 106, 113 and 115, such structures will hereinafter be referred to as "grids" for ease of description.

A first DC power source 122 is connected to voltage plate 102 for supplying a predetermined DC voltage potential $V_o$ thereto and a second DC power source 124 is connected to voltage grid 106 for supplying another predetermined DC voltage potential $V_2$ thereto. Although $V_o$ and $V_2$ may be widely varied, such as within the range of +/−30 kV for example, both plate 102 and grid 106 are typically maintained at the same voltage, and in one embodiment, this voltage is 15 kV. A first voltage pulser 128 is connected through a capacitor $C_1$ to voltage plate 102 (or grid 106) for supplying a predetermined duration voltage pulse to plate 102 (or grid 106) of a predetermined amplitude.

Because the DC voltages applied to plate 102 (or grid 106) via power source 122 are typically higher than most known high voltage pulser circuits 128 can withstand, the voltage pulser circuit 128 is isolated from plate 102 (or grid 106) by a high voltage capacitor $C_1$. Thus, when voltage pulser 128 is idle, it is decoupled from power source 122. When pulsed, the voltage transient produced by voltage pulser 128, typically on the order of a few kilovolts, is coupled to plate 102 (or grid 106) having a voltage on the order of tens of kilovolts applied thereto via power source 122. Occasionally in instruments such as TOF mass spectrometer 100 operating at high voltages, arcing can occur therein whereby plate 102 and/or grid 106 may be instantaneously forced to ground or much lower potential. As a result of the capacitive coupling between plate 102 (or grid 106) and voltage pulser 128, the entire voltage transient produce by such arcing is impressed upon the output of the voltage pulser 128. Heretofore, known voltage pulser circuits 128 have been formed of solid state circuitry that is not designed to withstand large transients produced by such arcing events. Consequently, known voltage pulser circuits 128 are routinely destroyed during typical operation of instruments such as instrument 100.

Figure 2:
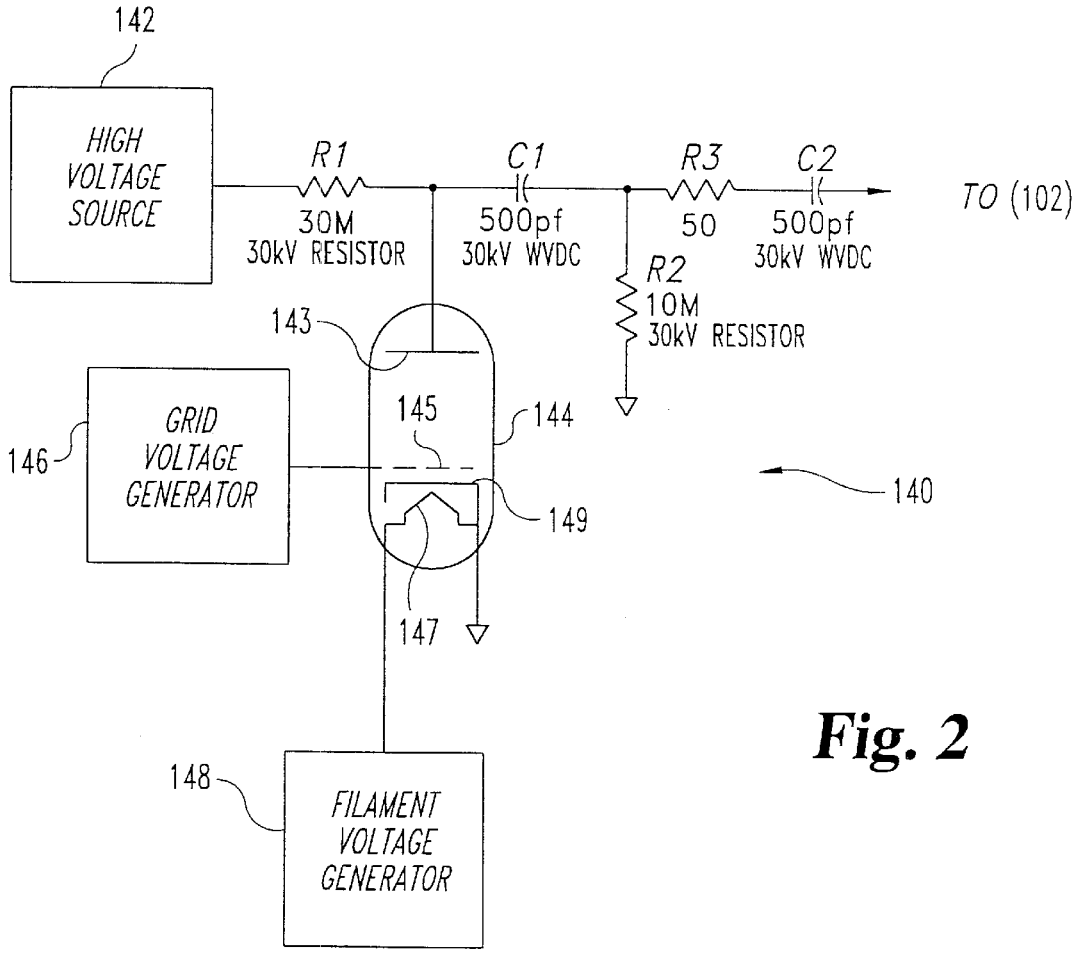
FIG. 2 is a diagrammatic illustration of one preferred embodiment of a high voltage switch for use as a voltage pulsing device in the operation of a mass spectrometer instrument such as the instrument illustrated in FIG. 1, in accordance with one aspect of the present invention.

Referring now to FIG. 2, a robust voltage pulser circuit 140, in accordance with one aspect of the present invention, is shown which overcomes the foregoing drawbacks associated with known voltage pulser circuits 128. Voltage pulser circuit 140 may replace the voltage pulser 128 and capacitor $C_1$ illustrated in FIG. 1, wherein voltage pulser circuit 140 includes a high voltage source 142 connected to one end of a resistor R1 having an opposite end connected to one end of a capacitor C1 and also to an anode 143 of a thyratron tube 144 of known construction. A grid 145 of tube 144 is connected to a grid voltage generator 146 and a filament 147 of tube 144 is connected to a filament voltage generator 148. A cathode 149 of tube 144 is connected to ground potential. The opposite end of capacitor $C_1$ is connected to one end of a resistor R2 having an opposite end connected to ground potential, and to one end of another resistor R3. The opposite end of resistor R3 is connected to one end of another capacitor C2 having an opposite end adapted for connection to plate 102 (or grid 106).

High voltage source 142 is preferably a DC voltage source supplying a desired DC voltage to the anode 143 of tube 144. In one embodiment, thyratron tube 144 is a 5C22 thyratron tube commercially available through ITT Corp. having a maximum anode voltage of 16 kV. High voltage source 142, in this embodiment, may accordingly be set at any desired DC voltage less than or equal to 16 kV. It is to be understood, however, that the present invention contemplates using other known embodiments/models of thyratron tube 144 that may have a maximum anode voltage rated above or below 16 kV, wherein such alternate thyratron tubes may accordingly be chosen to provide desired pulse voltage values. In this embodiment, R1 is preferably 30 Mohm, R2 is preferably 10 Mohms, R3 is preferably 50 ohms, and C1 and C2 preferably each have values of 500 pf, wherein all such components are preferably rated at 30 kV. It is to be understood that the values of components R1–R3 and C1–C2 may be chosen to suit any particular application, wherein the values of such components may be selected to effectuate a desired rise/fall time of the voltage pulse produced at the output of capacitor C2.

The filament voltage generator 148 may be of known construction and in the configuration of voltage pulser circuit 140 illustrated in FIG. 2, generator 148 is operable to impress a suitable low voltage upon filament 147 as is known in the art. Grid voltage generator 146 must be capable of supplying a suitable switched control voltage to grid 145 to activate/deactivate the thyratron tube 144 in a manner that will be described more fully hereinafter. In an embodiment wherein tube 144 is a model 5C22 thyratron tube, the grid 145 may be driven between approximately −360 volts and +80 volts. Grid voltage generator 146 may accordingly comprise known solid state circuitry capable of switching between these voltages. Alternatively, grid voltage generator 146 may comprise a second thyratron tube suitably driven to provide switching between desired voltage values of grid 145. In either case, the triggering or switching of grid voltage generator 146 is preferably electronically controlled to thereby accurately control the timing of the voltage pulse supplied by voltage pulser circuit 140 to plate 102 (or grid 106) of the TOF mass spectrometer 100.

In the operation of voltage pulser circuit 140, high voltage source 142 defines a desired DC voltage at the anode 143 of the thyratron tube 144. When the grid 145 is triggered via grid voltage generator 146, the anode 143 drops to the grounded potential of the cathode 149 of tube 144 within a few nanoseconds, thereby transferring a corresponding voltage pulse to plate 102 (or grid 106) of a desired potential. Preferably, the grid 145 is subsequently de-triggered via grid voltage generator 146 before high voltage source 142 can transfer significant charge to the anode 143 so that a well-defined pulse results at plate 102 (or grid 106).

In an alternative embodiment of voltage pulser circuit 140, the thyratron tube 144 may be connected in an inverted manner such that the cathode 149 is connected to the common connection of R1 and C1 and the anode 143 is connected to ground potential. The high voltage source 142 is configured to supply a suitable negative voltage to cathode 149, and the filament voltage generator 148 is preferably configured to power filament 147 through a high voltage isolation transformer. In this case, grid 145 is suitably controlled via grid voltage generator 146 such that cathode 149 rises from the negative potential provided by source 142 to the grounded potential of the anode 143 within a few nanoseconds, thereby transferring a corresponding voltage pulse to plate 102 (or grid 106) of a desired potential. As in the previous case, the grid 145 is subsequently de-triggered via grid voltage generator 146 before high voltage source 142 can transfer significant charge to the cathode 149 so that a well-defined pulse results at plate 102 (or grid 106). In either case, the thyratron tube 144 provides a rugged high voltage switch suitable for pulsing plate 102 or grid 106 of instrument 100 that is much less susceptible to transient induced damage than known structures of voltage pulser circuit 128.

In any case, voltage pulser 128 or 140 preferably supplies a voltage pulse $V_p$ to voltage plate 102 so that the total voltage present at plate 102 $V_1$ is the sum of the DC voltage $V_o$ and the voltage pulse $V_{p'}$ thereby establishing an electric field $E_1$ of predetermined strength within the first region 108 for the duration of the pulse. In an alternate embodiment, the output of voltage pulser 128 or 140 may be used to change the electric field that had previously been established across region 108 by power sources 122 and 124. Voltage pulser 128 or 140 may further be connected to grid 106 instead of plate 102. In any case, the electric field $E_1$ established within the first region 108 of instrument 100 acts to accelerate positively charged ions present within the region 108 toward the ion detector 116. The electric field $E_1$ could alternatively be reversed to accelerate negatively charged ions toward the detector 116.

A third DC power source 126 is connected to voltage grid 113 for supplying a predetermined DC voltage potential $V_3$ thereto. Although the voltage $V_3$ on grid 113 may also be widely varied, such as within the range of +/−30 kV for example, this voltage is, in operation, maintained below the voltage on grid 106 so that a second electric field $E_2$ is established within region 110 for further accelerating positively charged ions entering region 110 toward the detector 116. In one embodiment, the voltage on grid 113 is maintained at approximately 12 kV.

A fourth DC power source 129 and a second voltage pulser 130 or 140 are connected to the detector 116. In operation, the fourth DC power source 129 supplies a constant potential $V_4$ to the detector 116 of sufficient magnitude to establish an electric field $E_3$ for further accelerating ions entering region 18 toward the detector 116. Although the voltage $V_4$ on the detector 116 may be widely varied, such as within the range of ±30 kV for example, $V_4$ is typically set at approximately −1.4 kV. In one embodiment, voltage pulser 130, capacitively coupled to the detector 116 through a capacitor $C_2$, supplies a voltage pulse to the detector 116 to increase the gain of the detector 116 for the duration of the pulse to facilitate data capture. Alternatively, a voltage pulser circuit 140 of FIG. 2 may be used to supply such a voltage pulse to the detector 116. In other alternative embodiments, other known methods of momentarily increasing the gain of the detector 116 may be used to enhance data capture or data capture may be enhanced by preventing, through the use of pulsed ion deflectors, unwanted ions from reaching the detector.

Finally, a laser or other suitable ion excitation source 132 is focused on the sample source 104 for generating ions therefrom. Typically, the laser is pulsed by suitable control electronics and it is assumed that ions are desorbed from the sample source 104 upon being subjected to the laser radiation pulse.

Ion time-of-flight within a TOFMS, such as TOFMS 100, is typically mathematically modeled by breaking down the flight path into a series of segments, determining the ion flight time within each segment, and then summing the flight times of the various segments to arrive at a total ion flight time. A variable number of segments may be used to mathematically model the flight time in a time-of-flight instrument. In the example that follows, the TOFMS 100 flight path is broken down into four segments corresponding to regions 108, 110, 114, and 118. Alternatively, for example, region 118 could be further broken down into region 121, extending between grids 115 and 119, and region 120, extending between grid 119 and the front surface 117 of the microchannel plate detector 116, in which case the flight path would have five segments.

Using the four segment approach, in a preferred embodiment where power supplies 122, 124, 126, and 129 provide DC voltages, the flight time $t_1$ of ions within region 108 is a function of the component of the initial ion velocity along the flight tube axis (parallel to the electric fields $E_1$–$E_3$) $v_o$, the velocity of the ions leaving region 108 $v_1$ and the acceleration strength $a_1$ of the electric field $E_1$ established within region 108. Thus $$t_1=(v_1 v_o)/a_1 \quad (1).$$

If $x_o$ is the position of a particular ion generated from the sample source 104, then $$v_1=\sqrt{2a_1(d_1-x_o)+v_o^2} \quad (2).$$

Similarly, the flight time $t_2$ of ions within region 110 is a function of the velocity of ions entering region 110 $v_1$, the velocity of ions leaving region 110 $v_2$ and the acceleration strength of the electric field $E_2$ established within region 110. Thus, $$t_2=(v_2-v_1)/a_2 \quad (3),$$

where $$v_3=\sqrt{2a_3d_3+v_2^2} \quad (4)$$

Furthermore, the flight time $t_4$ of ions within region 118 is a function of the velocity of ions entering region 118 $v_2$, the velocity of ions leaving region 118 $v_3$ and the acceleration strength $a_3$ of the electric field $E_3$ established within region 118. Thus, $$t_4=(v_3-v_2)/a_3 \quad (5),$$

where $$v_3=\sqrt{2a_3d_3+v_2^2} \quad (6).$$

Finally, since region 114 is an electric field free ion drift region, the ion flight time $t_3$ is a function only of the ion velocity $v_2$ through region 114 and the length L of region 114. Thus $$t_3=L/v_2 \quad (7).$$

Since the total ion flight time within the TOFMS 100 is the sum of the four flight time segments, the equation for the total flight time T within TOFMS 100 is $$T=f(a_1, a_2, a_3, d_1, d_2, d_3, L, x_o, v_o) \quad (8).$$

In general, the initial ion position $x_o$ is a function of the initial ion velocity $v_o$ and a delay time $\tau$, wherein $\tau$ is the delay time between the generation of ions at the sample source 104 and commencement of the pulsed ion drawout electric field $E_1$ established via voltages $V_1$ and $V_2$ at plate 102 and grid 106 respectively. Via substitution, equation (8) thus becomes $$T=f(a_1,a_2,a_3,d_1,d_2,d_3,L,v_o,\tau) \quad (9).$$

Equation (9) describes the time-of-flight of an ion in a time-dependent electrostatic field and can be used to calculate theoretical flight times of any ion. Equation (9) will hereinafter be referred to as the electrostatic time-of-flight function and those skilled in the art will recognize that the electrostatic time-of-flight function or equation for any TOF mass spectrometer will be defined by the internal structure of the spectrometer instrument as well as the timing and magnitudes of the various application voltages. All such variables will hereinafter be referred to as TOF mass spectrometer instrument operational parameters. It is to be understood that any TOF mass spectrometer configuration may be used in accordance with the present invention, and as the term "time-of-flight mass spectrometer" or "TOF mass spectrometer" is used hereinafter, it is to be understood to include any instrument operable to measure ion times of flight including, but not limited to, reflectron-type and multi-pass TOF mass spectrometers, wherein ion time of flight in any such instrument is definable in terms of a number of the instrument's operating parameters (i.e., an electrostatic equation).

Figure 3:
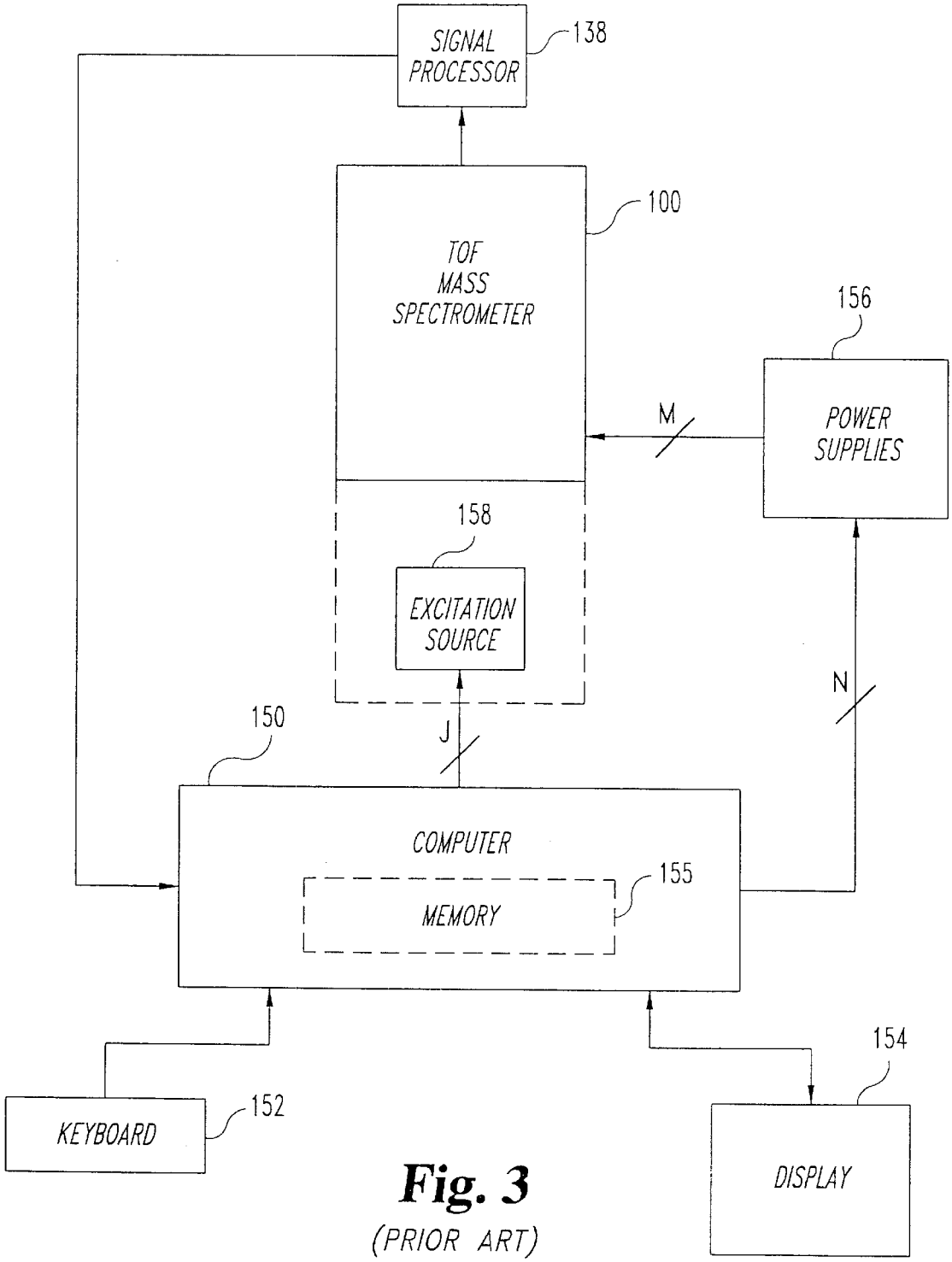
Fig. 3 (PRIOR ART)
FIG. 3 is a diagrammatic illustration of a prior art computer-based electronic interface to the instrument shown in FIG. 1.

Referring now to FIG. 3, a prior art electronic interface to the TOF mass spectrometer 100 of FIG. 1 is shown. Central to the interface of FIG. 3 is a computer 150. In one embodiment, computer 150 is preferably a microprocessor-based personal computer (PC) having at least a keyboard 152 and a display 154 electrically connected thereto as is known in the art. Alternatively, computer 150 may be any known computer suitable for controlling the operation of a TOF mass spectrometer, such as spectrometer 100, and for calibrating TOF mass spectra in accordance with the present invention. In any case, computer 150 preferably includes a memory 155 for storing application software algorithms and data relating to the operation of spectrometer 100 therein.

Computer 150 is shown in FIG. 3 as being electrically connected to a power supply block 156 via a number, N, of signal paths wherein N may be any integer. Power supply block 156 is, in turn, electrically connected to the TOF mass spectrometer 100 via a number, M, of signal paths wherein M may also be any integer. In one embodiment, power supply block 156 includes all of the power sources and voltage pulsers illustrated in FIG. 1 and/or FIG. 3 (e.g., sources 122, 124, 126 and 129, and voltage pursers 128 and 130 or 140), wherein computer 150 is operable to control the operation of all such sources/pulsers. In the case of voltage pulser 140 illustrated in FIG. 3, computer 150 is operable to at least control the timing of the trigger voltage supplied to the grid 145 of thyratron tube 144 as described hereinabove. Alternatively, the output voltage values of any one or more of the sources/pulsers may be manually controlled, although at least the activation/trigger times of voltage pulser 128 and voltage pulser 130 (or voltage pulser 140) are preferably controlled by the computer 150 or other known electronic control circuitry (not shown) in either case.

The computer 150 is also electrically connected to an excitation source 159 via a number, J, of signal paths wherein J may be any integer. In one preferred embodiment, and as illustrated in FIG. 1, excitation source 158 is a laser that is preferably positioned outside of the mass spectrometer 100. In this case, spectrometer 100 includes a window (not shown) in the vicinity of the sample source 104 so that radiation emitted from the laser 158 may pass through the window and excite the sample source 104 and generate ions therefrom. One example of a laser suitable for use as the excitation source 158 is a Quanta Ray DCR-2 Nd:YAG laser at 1.06 microns, although the present invention contemplates using any desired laser source as the excitation source 158 ranging from far-UV to far-IR. Additionally, the excitation source 158 may include a harmonic generator for multiplying the frequency of the laser radiation as desired.

In alternative embodiments, the excitation source 158 may be any known excitation source external to the spectrometer 100 or internal thereto as shown by the dashed lines surrounding the spectrometer instrument 100 in FIG. 3, and may furthermore include the sample source itself. In one alternate embodiment, for example, excitation source 158 may be a known electrospray ionization source either internal or external to instrument 100, wherein the electrospray source is operable to supply ions to instrument 100 in a known manner. As a specific example of this embodiment, the TOF mass spectrometer 100 and electrospray ionization source may be configured to supply a continuous stream of ions through region dl that is substantially parallel to plate 102 and grid 106, whereby plate 102 and/or grid 106 may be suitably pulsed to advance a packet of ions from this continuous stream toward the detector 116. Alternatively, an ion collection trap or ion filter of known construction may be included within region 108 or prior thereto, wherein excitation source 158 may include either a laser or an electrospray ionization source supplying ions to the ion trap or ion filter. In this embodiment, the computer 150 is operable, as is known in the art, to control the ion trap or ion filter in such a manner so as to trap a bulk of ions therein for subsequent injection into region 108 or to allow passage therethrough of ions having only selected mass/charge values. It is to be understood, in any case, that the present invention contemplates that the sample source 104 and excitation source 158 may be provided as any known ion source or combination of ion sources, and that any such ion source or combination of sources are intended to fall within the scope of the present invention. For example, the present invention contemplates employing other known ion sources and/or ion generation techniques as well, including, for example, fast atom bombardment (FAB), plasma desorption (PD), secondary ion generation such as that used in secondary ion mass spectrometry (SIMS), electron bombardment, photo-ionization, inductively coupled plasma (ICP), and the like.

An ion detector (116 in FIG. 1, but not shown in FIG. 3) is electrically connected to a signal processing circuit 138 that is, in turn, electrically connected to computer 150. Preferably, signal processing circuit 138 includes circuitry to convert the typically analog time-of-flight signals provided by detector 116 to digital signals suitable for use by computer 150. Signal processing circuit 138 may accordingly include known signal-to-waveform digitizer circuitry, known time-to-digital conversion circuitry or the like. In any case, computer 150 is operable to receive from TOF mass spectrometer 100 ion detection signals indicative of detection of ions at the ion detector 116.

Figure 4:
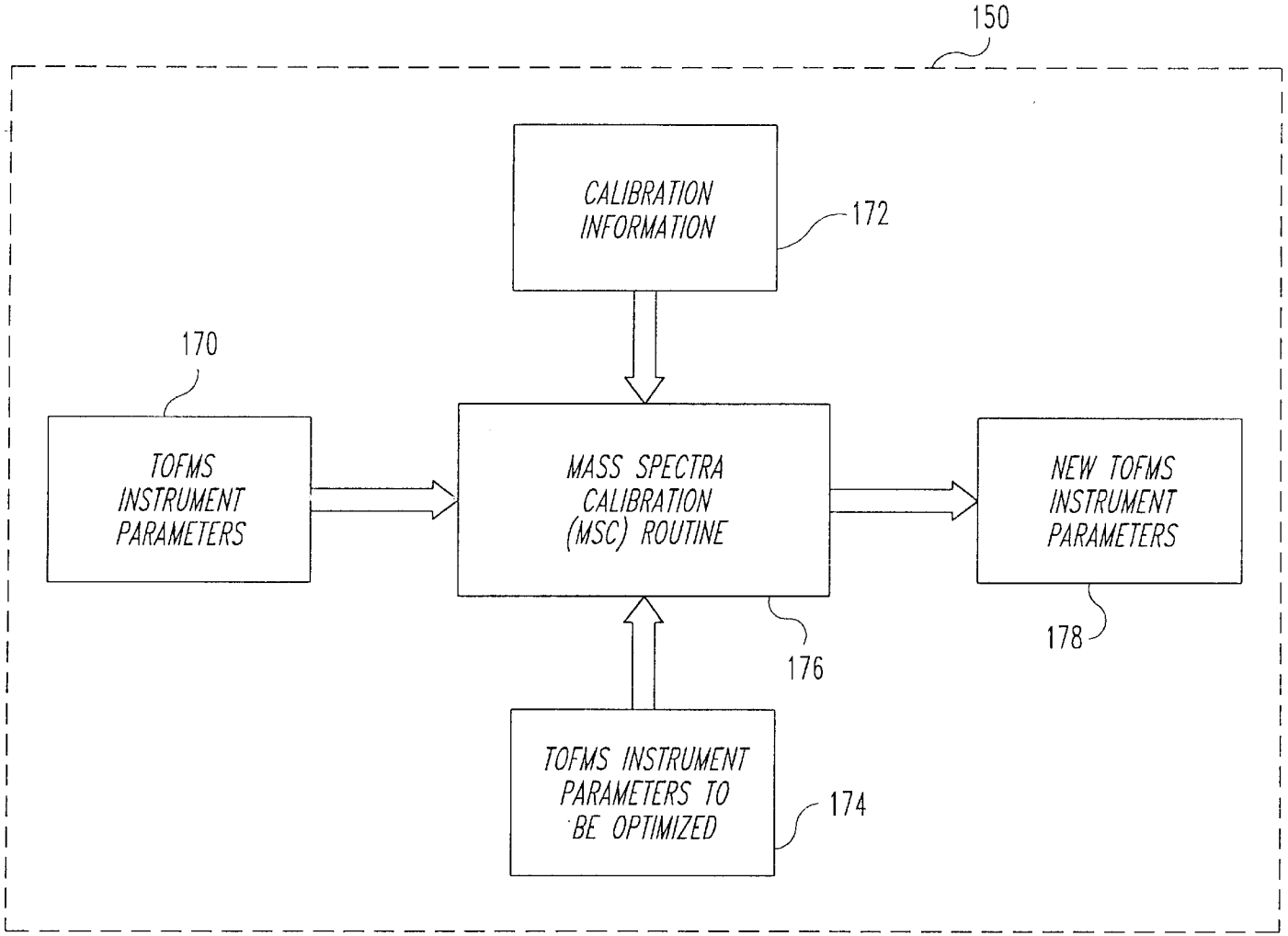
FIG. 4 is a diagrammatic illustration of one preferred embodiment of some of the internal features of the computer illustrated in FIG. 3, in accordance with another aspect of the present invention, for calibrating time-of-flight mass spectra.

In accordance with the present invention, computer 150 preferably includes a software algorithm stored within memory 155, whereby computer 150 is operable to conduct time-of-flight mass spectra calibrations. Unlike prior art systems that conduct mass spectra calibrations by curve fitting experimental data to a polynomial expression, however, the mass spectra calibration technique of the present invention is operable to optimize numerical values of one or more of the operating parameters of a TOF mass spectrometer, such as TOF mass spectrometer 100, to thereby minimize the residual error between electrostatic TOF calculations and measured TOF values for a range of known ion masses. To this end, FIG. 4 illustrates one preferred embodiment of some of the internal features of computer 150 for carrying out such mass spectra calibrations. It is to be understood that the blocks illustrated in FIG. 4 are not intended to represent a physical internal structure of computer 150, but are rather intended to represent software functions that are preferably implemented via one or more software algorithms stored within memory 155.

Referring now to FIG. 4, computer 150 includes a block 170 corresponding to the various TOF mass spectrometer instrument operating parameters that, together with known mass/charge values, define times-of-flight of a wide range of ions in a time-dependent electrostatic field. This time-of-flight function, or time-of-flight electrostatic equation, can then be used to calculate theoretical flight times of any ion. Preferably, such instrument operating parameters are stored within memory 155 and may be entered therein via a number of known techniques including, but not limited to, keyboard 152, transfer from another storage media such as a diskette, transfer from a remote system via a modem or internet access, or the like.

Using the TOF mass spectrometer of FIG. 1, for example, an ion's time-of-flight is defined in terms of its mass/charge ratio and a plurality of instrument operating parameters including $a_1$–$a_3$, $d_1$–$d_3$, L, $v_0$ and $x_0$ (or $\tau$) (see eqns. 8 and 9). Thus, block 170 preferably includes the values of $d_1$–$d_3$, L, $v_0$ and $\tau$ as well as the voltage values of voltage source 122, 124, 126 and 129 and voltage pulsers 128 (or 140) and 130. With other TOF mass spectrometer embodiments, additional and/or alternative parameters may be necessary to define the time-of-flight electrostatic equation. For example, equation 8 or 9 may be modified to include time dependent information relating to the pulsed ion drawout electric field described above including, but not limited to, pulse start time and/or pulse rise time. For any embodiment of the TOF mass spectrometer, however, it is to be understood that block 170 includes any instrument operating parameters necessary to define an electrostatic time-of-flight equation therefore.

Computer 150 further includes a calibration information block 172 that preferably includes a number of pairs of known ion mass values and associated time-of-flight values that were previously measured for these known mass values with the time-of-flight mass spectrometer defining the TOF mass spectrometer instrument parameters of block 170. In general, the range of mass values contained in the calibration information block 172 defines the mass range of the subsequent mass spectra calibration. In accordance with an important aspect of the present invention, however, the post-calibration instrument operating range may include mass values well outside the mass calibrant range without losing significant mass accuracy as will be described and demonstrated with respect to FIG. 8. The present invention further contemplates that a mass spectra calibration may be conducted using as little as a single known mass value and associated measured time-of-flight value, or alternatively any number of known mass values and associated measured time-of-flight values. Block 172 accordingly includes at least one known mass value and associated measured time-of-flight value, and may include any number of mass/time-of-flight data pairs. Preferably, such one or more mass/time-of-flight data pairs are stored within memory 155 and may be entered therein via a number of known techniques including, but not limited to, keyboard 152, transfer from another storage media such as a diskette, transfer from a remote system via a modem or internet access, or the like.

Computer 150 further includes a block 174 that corresponds to desired TOF mass spectrometer instrument operating parameters to be optimized. Generally, the values of the various instrument operating parameters defining an electrostatic time-of-flight function may not exactly match their true values due to errors in parameter measurement. Thus any one or more of the mass spectrometer instrument operating parameters may be chosen in block 174 for adjustment (optimization) thereof in order to calibrate the electrostatic equation to yield more accurate time-of-flight values (and hence more accurate mass values) based on the known mass and measured time-of-flight calibration information stored in block 172. As a practical matter, however, the best choices for parameters to optimize are those that are most subject to measurement errors. An obvious choice for an optimization parameter is any pulse voltage, since all high voltage pulses are produced by high impedance sources, and any measurement thereof loads the source and accordingly produces a lower measured voltage than is actually impressed. Another good choice for an optimization parameter is the extraction delay time $\tau$ since propagation delays in signal lines and delay generators may change the actual delay time from its measured value. Other good choices for optimization parameters have been found to include, for example, ion start time, which corresponds to the time at which source ions are generated, and the length L of the flight tube.

Computer 150 further includes a mass spectra calibration (MSC) routine block 176 that receives the above-described data from blocks 170, 172 and 174 and produces a "new" set of TOF mass spectrometer operational parameter values, wherein the new set of instrument operational parameters includes adjusted or optimized values for the instrument parameters chosen in block 174. Given the known mass and measured time-of-flight calibration pairs provided by block 172, the mass spectra calibration block 176 is operable, as will be described in greater detail hereinafter, to adjust chosen ones of the various TOF mass spectrometer instrument operational parameters provided by block 170 until the calibration pairs agree with the electrostatic TOF function defined by the instrument operational parameters, wherein the instrument operational parameters chosen for adjustment are established by block 174.

Figure 5:
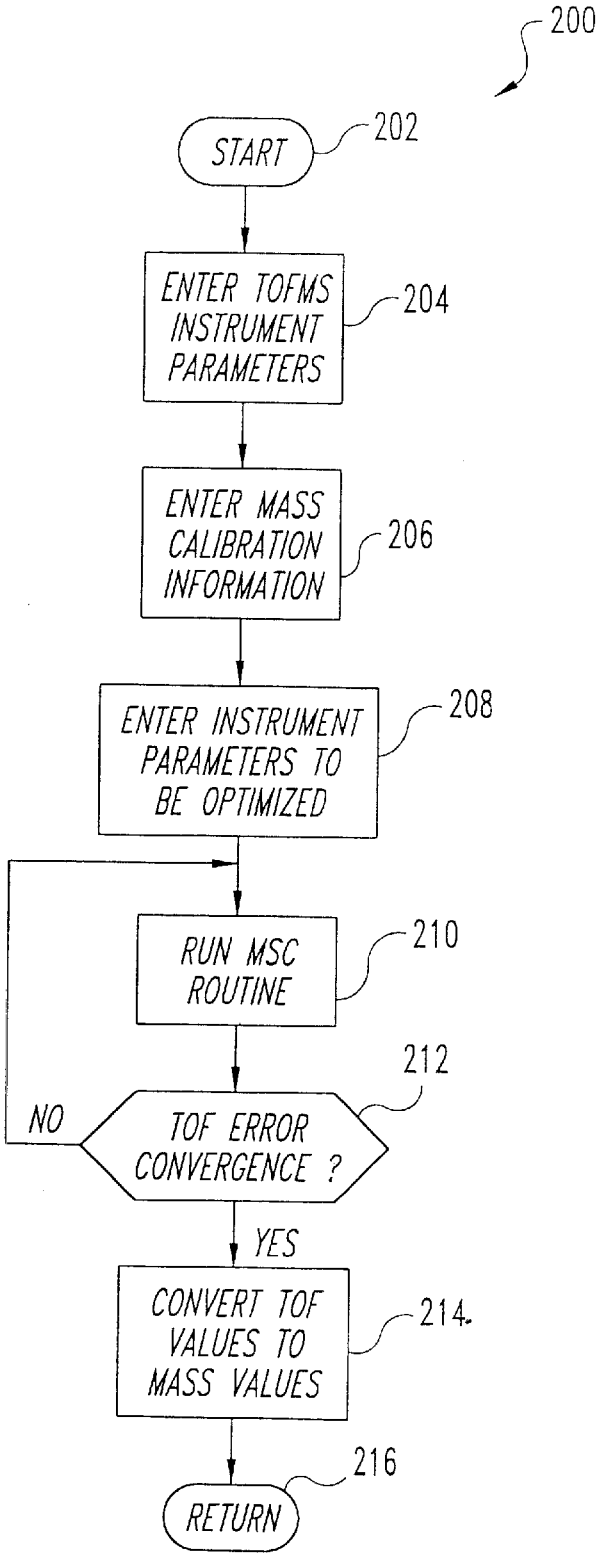
FIG. 5 is a flowchart illustrating one preferred technique for calibrating time-of-flight mass spectra with the electronic interface embodiment shown in FIGS. 3 and 4, in accordance with the present invention.

Referring now to FIG. 5, a flowchart is shown illustrating one preferred embodiment of a software algorithm 200 for carrying out a time-of-flight mass spectra calibration in accordance with the foregoing description of FIG. 4. As described hereinabove, algorithm 200 is preferably stored within memory 155 and is executable by computer 150. Algorithm 200 begins at step 202 and at step 204, the various TOF mass spectrometer instrument operational parameters described with respect to block 170 of FIG. 4 are entered into memory 155 according to any of the techniques described above. Thereafter at step 206, a number (at least one) of known mass and associated measured time-of-flight value pairs are entered into memory 155 according to any of the techniques previously described. Thereafter at step 208, the TOF mass spectrometer instrument parameters chosen to be optimized are entered into memory 155 according to any of the techniques described hereinabove. In one preferred embodiment, as will be described in greater detail hereinafter, the mass spectra calibration routine of block 176 is a simplex optimization routine operable to adjust the chosen instrument parameters such that the known mass and measured time-of-flight calibration data corresponds to the electrostatic time-of-flight calculations for the various mass values.

After the execution of step 208, all data necessary for the time-of-flight mass spectra calibration according to the present invention are stored in memory 155, and algorithm execution continues at step 210 where computer 150 is operable to run the mass spectra calibration (MSC) routine of block 176. In one preferred embodiment of the present invention, the mass spectra calibration routine of block 176 and step 210 includes a simplex optimization routine. While various methods are known for determining optimal parameters for a system, simplex algorithms are adaptable to uncompliant optimizations such optimization of empirical variables that are either underdetermined or whose measurements are obscured by experimental error. Such algorithms show improved efficiency when more factors are included in the optimization and computer algorithms utilizing simplex calculations have been known to permit the optimization of systems that are impossible to fit to an analytical expression either for lack of an analytical expression or due to intractably complicated numerical calculations. A simplex algorithm can accordingly be applied to a time-of-flight calculation without determining exact experimental parameters. The process of optimization refines the experimentally determined parameters of the TOF mass spectrometer instrument, thereby allowing for the subsequent accurate determination of unknown masses using measured time-of-flight data.

Figure 6:
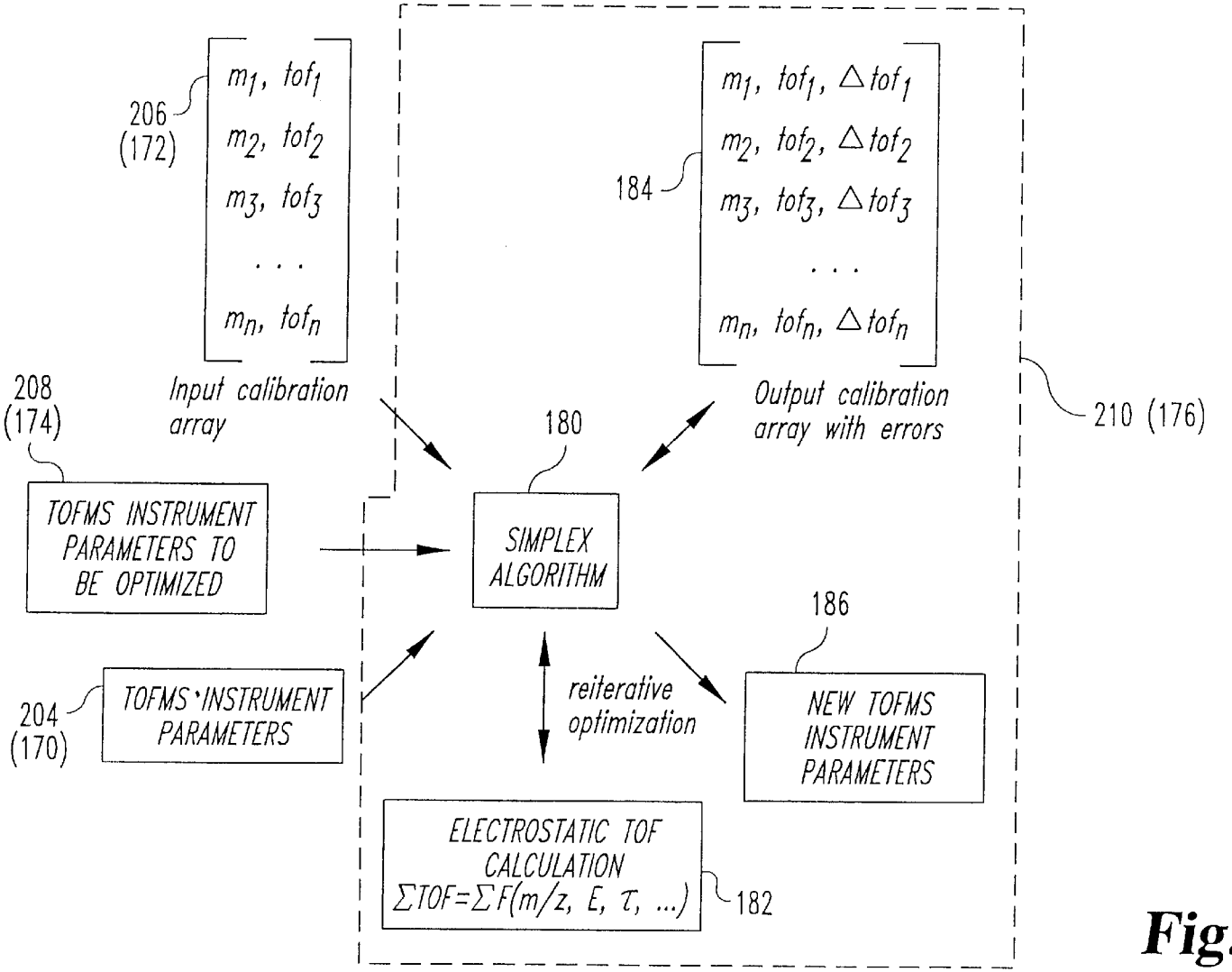
FIG. 6 is a diagrammatic illustration of one preferred embodiment of the mass spectra calibration routine of FIG. 5, in accordance with the present invention.

Referring now to FIG. 6, a block diagram illustrating the mass spectra calibration routine of block 176 and step 210, in accordance with a preferred simplex optimization routine, is illustrated. Blocks 170, 172 and 174, corresponding to steps 204, 206 and 208 respectively of algorithm 200, are shown in FIG. 6 as providing necessary data to a simplex algorithm block 180 of the mass spectra calibration block 176 (step 210). The simplex algorithm 180 is operable to perform reiterative optimization of the electrostatic time-of-flight function 182 defined by the TOF mass spectrometer instrument operational parameters provided by block 204, given the input calibration array of mass/time-of-flight data pairs provided by block 206 and instrument parameters chosen for optimization by block 208, and produce an output calibration array with errors 184 at each iteration. The iteration process continues until the residual error in times-of-flight $\Delta tof_{1-n}$, between the measured time-of-flight values within block 206 and the electrostatic time-of-flight calculations is minimized over the mass range defined by the known mass values in the mass calibration information. The result of the simplex optimization routine illustrated in blocks 180–184 is a new set of TOF mass spectrometer operational parameters 186 for use in the electrostatic equation which includes the original instrument parameter values provided by block 204 for all but the optimized instrument parameters along with the optimized instrument parameter values for those instrument parameters chosen for optimization by block 208.

A simplex engine that was developed for block 180 of FIG. 5 was adapted from an amoeba algorithm described in "Numerical Recipes in C: The Art of Scientific Computing", W. H. Press, S. A. Teukolsky, W. T. Vetterling, B. P. Flannery, Second Edition, Cambridge University Press (1992). A primary change to this algorithm for mass spectra calibration involved the incorporation therein of a residual error function. In this minimization function, optimized TOF values are calculated using all of the TOF mass spectrometer instrument operational parameters for each calibrant mass. The residual between an array of optimized TOF values and measured TOF values is calculated in this function as described hereinabove. In practice, any known minimization function may be used to compute the residual, although variations in this minimization show differing performance in terms of convergence speed and accuracy. In one preferred embodiment, the difference of the square of TOF values between experimental and optimized values therefore is used.

A further change to the amoeba algorithm involves the packing and unpacking of instrument conditions. Packing involves flagging the instrument parameters chosen for optimization and loading these parameters into a compatible matrix. Consistency between packing and unpacking is essential as each iteration of the simplex algorithm requires unpacking of this matrix for the electrostatic TOF calculation. In other words, the simplex algorithm requires a packed matrix to navigate the error simplex, but requires an unpacked matrix for computation of the optimized TOF values. C++ served as an optimal programming language for the simplex algorithm as the object-oriented nature of this language greatly simplifies the foregoing changes.

One parameter of the simplex optimization procedure, termed the "delta value" can be changed to correct for uncertainties in individual parameters. Lowering the delta value increases the iterative requirements for optimization and the delta value may be different for each instrument parameter. In general, it was found desirable to match the delta value to expected uncertainties in the measurements of instrument parameters. A further parameter, termed the "fit tolerance", represents convergence criteria for termination of the simplex optimization process. The fit tolerance value is based on expected error between the measured TOF values and the TOF values determined by the electrostatic equation and, as with the delta value, a smaller fit tolerance value increases the iterative requirements of the overall procedure.

Returning again to FIG. 5, algorithm 200 advances from step 210 to step 212 where computer 150 tests for TOF error convergence, as just described with respect to FIG. 6, and loops back to step 210 until such convergence occurs. Thereafter at step 214, computer 150 is operable to convert the final electrostatic TOF values to mass values. Once optimized instrument operational parameter values are determined at step 210, conversion of resulting electrostatic TOF values to corresponding mass values is necessary to calibrate unknown masses for arbitrary TOF values. In one preferred embodiment, a known high-low search algorithm is employed at step 214 which searches the trial masses until the experimental TOF value matches the unknown mass. It has been found that a 133 MHz Pentium-based computer 150 can calculate individual masses based on times-of-flight, and calibrate a 16 kilopoint data file in less than one minute to parts-per-trillion accuracy, although the present invention contemplates other embodiments of computer 150 as described hereinabove. As a refinement to the above-described high-low search algorithm, the initial mass guess may be based on the previous call, thereby speeding calculations for nearby mass values. In any case, algorithm 200 advances from step 214 to step 216 where algorithm 200 is returned to its calling routine.

It is to be understood that while algorithm 200 was described as including a simplex optimization-based mass spectra calibration routine 176, the present invention contemplates utilizing other known parameter optimization procedures, an example of which includes, but is not limited to, a least squares optimization approach. Those skilled in the art will recognize that other such substitute parameter optimization procedures may alternatively be used in practicing the present invention without detracting from the scope thereof.

From the foregoing it should now be appreciated that rather than approximating ion TOF values based on an empirical equation as is the case with known curve fitting techniques, the time-of-flight mass spectra calibration technique of the present invention utilizes electrostatic calculations of ion flight times for conducting such calibrations. The electrostatic calculation of ion TOF values constrains ion behavior to physically meaningful values based on the various operational parameters of the particular TOF mass spectrometer used. Deviations in ion TOF values can accordingly be attributed to one or more experimental parameters, and while the factors that represent these parameters can be included in a conventional curve fit equation, the terms of a curve fit equation are representations of multiple constants in an infinite expansion and are therefore not as exact as using all instrument operational parameters in the electrostatic TOF calculation. The mass calibration technique of the present invention, by contrast, takes into account all of the instrument operational parameters in arriving at a final calibration. Because the electrostatic TOF calculation is a description of ion behavior in an actual TOF mass spectrometer instrument rather than a polynomial representation of a curve, it is well behaved and does not contain any instabilities where unpredictable calibration errors might occur.

Figure 7:
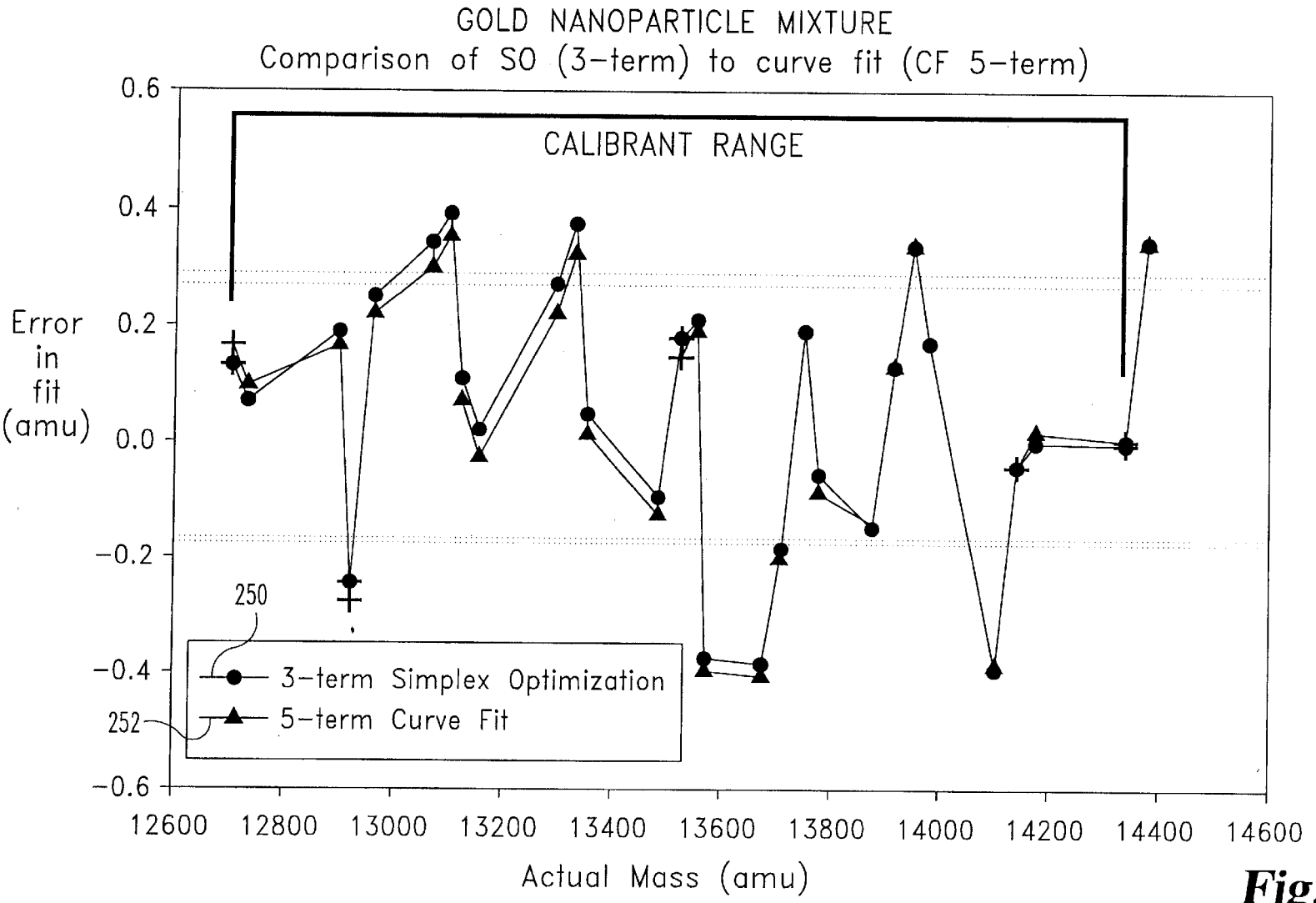
FIG. 7 is a plot of error in fit vs. actual mass for a gold nanoparticle mixture comparing a 5-term conventional curve fit mass spectra calibration technique to a 3-term mass spectra calibration technique of the present invention.
Figure 8:
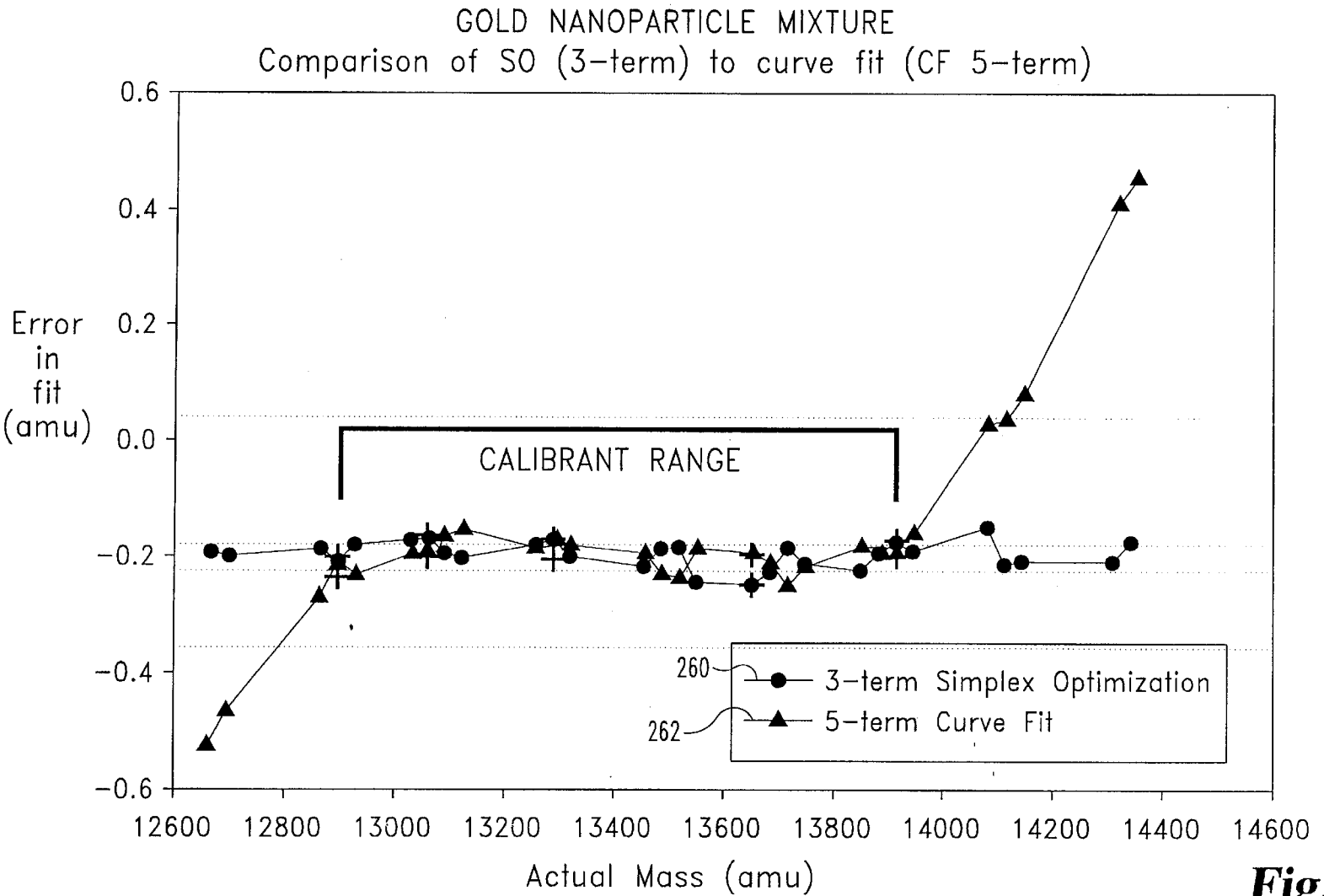
FIG. 8 is a plot of error in fit vs. actual mass for a gold nanaoparticle mixture similar to that shown in FIG. 7 wherein the respective mass spectra calibration techniques were conducted over a more narrow mass range than for the plot shown in FIG. 7.

Referring now to FIG. 7, a plot of error in fit vs. actual mass for a gold nanoparticle mixture is shown. A 3-term simplex optimization error 250, according to the techniques described hereinabove with respect to FIGS. 4–6, is compared with a 5-term curve fit error 252 using known curve fitting techniques. Inspection of FIG. 7 reveals that the 3-term simplex optimization technique of the present invention produces results that are at least as accurate as that of the known 5-term curve fitting technique. Referring to FIG. 8, a similar plot of error in fit vs. actual mass for a gold nanoparticle mixture is shown wherein a 3-term simplex optimization error 260 is again compared with a 5-term curve fit error 262. Comparing FIG. 7 with FIG. 8, the 3-term simplex optimization procedure of the present invention and the 5-term curve fit mass calibration illustrated in FIG. 8 was conducted over a narrower mass range than that of FIG. 7 and the results thereof are readily apparent. Outside of the mass range of the known mass values used for the calibration (mass calibrant range), the 5-term curve fit calibration procedure of FIG. 8 produces potentially highly inaccurate results whereas the 3-term mass calibration procedure of the present invention produces results that are consistent with those within the mass calibrant range. Accordingly, the mass calibration procedure of the present invention advantageously provides greater accuracy in mass value determination than known curve fitting techniques in extrapolated mass ranges.

While the invention has been illustrated and described in detail in the foregoing drawings and description, the same is to be considered as illustrative and not restrictive in character, it being understood that only the preferred embodiments have been shown and described and that all changes and modifications that come within the spirit of the invention are desired to be protected.

What is claimed is:

1. A voltage pulser circuit, comprising:

a voltage source having an output producing a first voltage;

a switch having a first terminal coupled to the output of the voltage source and a second terminal connected to a reference potential;

a pulse-shaping circuit having a first capacitor connected at one end to the first terminal of the switch, first and second resistors each connected at one end to the opposite end to the first capacitor, the opposite end of the first resistor connected to the reference potential, and a second capacitor connected at one end to the opposite end of the second resistor, the opposite end of the second capacitor defining an output of the voltage pulser circuit; and means for triggering the switch to electrically connect the first terminal to the second terminal and thereby produce a voltage pulse at the output of the voltage pulser circuit.

2. The voltage pulser circuit of claim 1 wherein the switch is a first thyratron tube having an anode defining the first terminal, a cathode defining the second terminal and a grid responsive to a control voltage to electrically connect the first terminal to the second terminal.

3. The voltage pulser circuit of claim 2 wherein the means for triggering the switch is a grid voltage generator producing the control voltage.

4. The voltage pulser circuit of claim 3 wherein the grid voltage generator is controllable to switch the control voltage to the grid for a period of time sufficient to produce the voltage pulse at the output of the voltage pulser circuit without significantly charging the anode of the first thyratron tube with the first voltage produced by the voltage source.

5. The voltage pulser circuit of claim 3 wherein the grid voltage generator is a solid state voltage switching circuit configured to switch between the control voltage and a reference control voltage.

6. The voltage pulser circuit of claim 3 wherein the grid voltage generator is a second thyratron tube configured to switch between the control voltage and a reference control voltage.

7. The voltage pulser claim 1 wherein the first voltage produced by the voltage source is a predefined DC voltage greater than the reference potential.

8. The voltage pulser circuit of claim 1 wherein the switch is a first thyratron tube having a cathode defining the first terminal, an anode defining the second terminal and a grid responsive to a control voltage to connect the first terminal to the second terminal.

9. The voltage pulser circuit of claim 8 wherein the first voltage produced by the voltage source is a predefined DC voltage less than the reference potential.

10. The voltage pulser circuit of claim 1 further including a resistor connected at one end to the output of the voltage source and at its opposite end to the first terminal of the switch.

11. The voltage pulser circuit of claim 1 wherein the output of the voltage pulser circuit is operatively connected to a spectrometer instrument.

12. The voltage pulser circuit of claim 11 wherein the spectrometer instrument is a time-of-flight mass spectrometer.

13. A voltage pulser circuit, comprising:

a voltage source having an output producing a first voltage;

a first thyratron tube having an anode coupled to the output of the voltage source, a cathode connected to a reference potential and a grid responsive to a control voltage to electrically connect the anode to the cathode, the anode coupled to an output of the voltage pulser circuit;

a pulse-shaping circuit having a first capacitor connected at one end to the anode of the first thyratron tube, first and second resistors each connected at one end to the opposite end to the first capacitor, the opposite end of the first resistor connected to the reference potential, and a second capacitor connected at one end to the opposite end of the second resistor, the opposite end of the second capacitor defining and output of the voltage pulser circuit; and a grid voltage generator configured to controllably switch the control voltage to the grid of the first thyratron tube to thereby cause the first thyratron tube to switch the output of the voltage pulser circuit between the first voltage and the reference potential.

14. The voltage pulser circuit of claim 13 wherein the grid voltage generator is controllable to switch the control voltage to the grid for a period of time sufficient to switch the output of the voltage pulser circuit between the first voltage and the reference potential without significantly charging the anode of the first thyratron tube with the first voltage produced by the voltage source.

15. The voltage pulser circuit of claim 13 wherein the grid voltage generator is a solid state voltage switching circuit configured to switch between the control voltage and a reference control voltage.

16. The voltage pulser circuit of claim 13 wherein the grid voltage generator is a second thyratron tube configured to switch between the control voltage and a reference control voltage.

17. The voltage pulser circuit of claim 13 further including a resistor connected between the output of the voltage source and the anode of the first thyratron tube.

18. The voltage pulser circuit of claim 13 wherein the output of the voltage pulser circuit is operatively connected to a spectrometer instrument.

19. The voltage pulser circuit of claim 18 wherein the spectrometer instrument is a time-of-flight mass spectrometer.

20. The voltage pulser circuit of claim 13 wherein the first voltage is a predefined DC voltage greater than the reference potential.

21. A voltage pulser circuit, comprising:

a voltage source having an output producing a first voltage;

a first thyratron tube having a cathode coupled to the output of the voltage source, an anode connected to a reference potential and a grid responsive to a control voltage to electrically connect the cathode to the anode, the cathode coupled to an output of the voltage pulser circuit;

a pulse-shaping circuit having a first capacitor connected at one end to the cathode of the first thyratron tube, first and second resistors each connected at one end to the opposite end to the first capacitor, the opposite end of the first resistor connected to the reference potential, and a second capacitor connected at one end to the opposite end of the second resistor, the opposite end of the second capacitor defining an output of the voltage pulser circuit; and a grid voltage generator configured to controllably switch the control voltage to the grid of the first thyratron tube to thereby cause the first thyratron tube to switch the output of the voltage pulser circuit between the first voltage and the reference potential.

22. The voltage pulser circuit of claim 21 wherein the grid voltage generator is controllable to switch the control voltage to the grid for a period of time sufficient to switch the output of the voltage pulser circuit between the first voltage and the reference potential without significantly charging the cathode of the first thyratron tube with the first voltage produced by the voltage source.

23. The voltage pulser circuit claim 21 wherein the grid voltage generator is a solid state voltage switching circuit configured to switch between the control voltage and a reference control voltage.

24. The voltage pulser circuit of claim 21 wherein the grid voltage generator is a second thyratron tube configured to switch between the control voltage and a reference control voltage.

25. The voltage pulser circuit of claim 21 further including a resistor connected between the output of the voltage source and the cathode of the first thyratron tube.

26. The voltage pulser circuit of claim 21 wherein the output of the voltage pulser circuit is operatively connected to a spectrometer instrument.

27. The voltage pulser circuit of claim 26 wherein the spectrometer instrument is a time-of-flight mass spectrometer.

28. The voltage pulser circuit of claim 21 wherein the first voltage is a predefined DC voltage less than the reference potential.

* * * * *